US006451400B1

(12) United States Patent
Brock et al.

(10) Patent No.: US 6,451,400 B1
(45) **Date of Patent: *Sep. 17, 2002**

(54) FLOOR MAT

(75) Inventors: Thomas A. P. Brock, Manchester (GB); Keijo J. Nurmentaus, Nurmijarvi (FI); Patrick Morel, Les Ulis (FR)

(73) Assignee: Milliken Denmark A/S, Morke (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/508,549

(22) PCT Filed: Sep. 10, 1998

(86) PCT No.: PCT/GB98/02737

§ 371 (c)(1),
(2), (4) Date: Jun. 5, 2000

(87) PCT Pub. No.: WO99/12465

PCT Pub. Date: Mar. 18, 1999

(30) Foreign Application Priority Data

Sep. 10, 1997 (GB) ..... 9719198

(51) Int. Cl.[7] ..... B32B 3/06; A47L 23/22

(52) U.S. Cl. ..... 428/44; 15/215; 15/216; 15/217; 15/161; 15/238; 15/239; 15/240; 15/241; 15/392; 52/177; 52/181

(58) Field of Search ..... 15/217, 216, 215, 15/161, 392, 238–241; 52/177, 181; 428/44

(56) References Cited

U.S. PATENT DOCUMENTS

| | | | | | |
|---|---|---|---|---|---|
| 612,065 | A | * | 11/1898 | Spickermann | 15/216 |
| D89,085 | S | * | 1/1933 | McFaul | 15/216 |
| 3,648,320 | A | * | 3/1972 | Woolley | 15/215 |
| 3,886,620 | A | * | 6/1975 | Miller et al. | 15/217 |
| 4,587,148 | A | * | 5/1986 | Campbell et al. | 428/88 |

* cited by examiner

*Primary Examiner*—Michael Barr
*Assistant Examiner*—Elena Tsoy
(74) *Attorney, Agent, or Firm*—Terry T. Moyer; Charlotte C. Wilson

(57) ABSTRACT

There is provided a mat having multiple sets of pins, each set of pins being located within surrounding, characterized in that the pins do not extend significantly beyond the highest point of the surrounding. Thus the pins are protected by the surrounding and are less likely to break after extended use. The mat may be provided with areas adapted for the receipt of strips of textile materials, eg carpeting which advantageously has a hard-backing and is able to snap into the areas provided. The inclusion of the textile material combines a scraping function together with the visual appearance of a carpet. The strips of textile material will be separated by sets of pins as described above. A set of such mats is also described.

13 Claims, 6 Drawing Sheets

FLOOR MAT

TECHNICAL FIELD

There is provided a floor covering suitable for use at an entry to a building.

It is known to have scraper mats at the entrances of building which enable a person to remove mud or dirt a from the underside of footwear prior to entry into the building. Such scraper mats may comprise bristles or may be rubber or PVC-based mats.

One known form of mat comprises multiple sets of pins, each set of pins being encircled by a surrounding and wherein the upwardly presented pin ends extend above the height of the surrounding and perform a scraping function. However it has been found that the pins are likely to break or become bent so that after extended use the scraping function of the mat is significantly decreased.

BRIEF DESCRIPTION

The present invention concerns a novel form of scraper mat, which may optionally incorporate areas for inclusion of carpeting.

The scraper mat of the present invention comprises multiple sets of pins, each set of pins being located within a surrounding, characterised in that the pins do not extend significantly beyond the highest point of the surrounding. Usually, the upper (free) ends of all of the pins within a surrounding will be level with or below the highest part of the surrounding. Advantageously, the upper (free) ends of the pins will be below the highest point of the surrounding.

Generally the mats of the present invention will be formed from materials such as rubber, plastics or thermoplastics. PVC or PVC-based materials are currently preferred, but alternative materials may be more environmentally acceptable.

The relative height of the pins and the surrounding is such that the upper ends of the pins do not protrude above the surrounding to any significant degree whilst still being of a sufficient height to aid removal of mud and dirt from the underneath of footwear. This has the advantage that the surrounding provides a degree of protection to the pins and reduces the vulnerability of the pins to breakage. The pins may be of a length chosen so that the upper (free) ends terminate at a substantially similar height to the surrounding or the upper (free) ends of the pins may terminate below the surrounding such that when a person steps onto the mat the weight of the person presses down on the surrounding and reduces the height of the surrounding by compressing or distorting it. Thus the ends of the pins are brought into contact with the lower surface of the person's footwear. Optionally the upper surface of the surrounding may be ridged or castellated.

The pins may extend from a shelf located in the base of the surrounding or otherwise in the lower portion of the mat. The presence of the shelf enables the length of the pins to be reduced whilst still ensuring that the upper ends of the pins terminate as described above. Reducing the length of the pins increases pin strength and lowers the incidence of pin breakage.

The pins may be of any cross-sectional shape, but for ease of manufacture will normally have a generally circular cross-section. Advantageously the pins will be tapered towards or rounded at their upper (free) ends. Tapering the free ends of the pins will contribute to their overall strength.

The set of pins may include any suitable number of pins, for example may comprise 4, 5, 6, 7, 8, 9, 10, 11 or 12 pins although other numbers of pins are also possible and the present invention is not limited to any particular number of pins in a set.

The surrounding located about the set of pins may be of any shape. In the embodiments illustrated the surroundings are generally circular, but other shapes (for example oval, triangular, square, rectangular, pentagonal, hexagonal, septagonal, octagonal or other polygonal shapes) of surrounding are also possible. Additionally there may be a mixture of suitable shapes.

Optionally, the mat is provided with areas adapted for the receipt of strips of textile materials, eg carpeting. The inclusion of the textile material combines a scraping function together with the visual appearance of a carpet. The strips of textile material will be separated by sets of pins as described above. Advantageously, the upper surface of the textile material will be level with the upper surface of the pin surroundings so that the upper surface of the whole mat is generally flat.

Additionally since these areas are intended to be covered by textile material it is possible to include therein holes for screwing the mat into position or any other means of holding the mat in place which would normally be visible from above. Suitable textile materials are as described in WO-A-96/37645.

The textile material may be simply glued into place. Where the textile material is to be glued to the mat, the areas adapted for receipt of the strips of textile material may optionally have a non-smooth upper surface to provide a good surface to hold the glue.

Alternatively, if the textile material has a suitably hard backing, it may simply be snapped into the area of the mat. Optionally the area of the mat may be adapted to receive and hold a hard-backed section of textile material. For example the area may be provided with a lip which will lie over the top surface of the inserted hard-backed textile material, thereby retaining it in the mat.

Optionally, the mats of the present invention may be adapted to be releasably attached to similar mats. Thus, mats With textile portions may be attached to other forms of mats (for example mats without textile portions) in discrete units to form a combination of mats suitable for any particular location or purpose. This arrangement has the advantage of being extremely versatile. A tile mat edging system, for example as described in UK Registered Design No. 2062315, may be present if desired.

BACKGROUND

In a further embodiment the present invention provides a set of floor coverings comprising a first floor covering, a second floor covering and a third floor covering; wherein the first floor covering is a mat according to the invention, the second floor covering is a mat according to the invention and having strips of textile material incorporated therein and the third floor covering is a textile floor covering (eg a carpet). Desirably the textile portion(s) of the second floor covering are identical to or co-ordinate with the third floor covering. Generally the set of floor coverings is so placed that a person entering a building will first walk over the first floor covering, then the second floor covering and finally the third floor covering which will usually be chosen to co-ordinate with, or to match, the carpet of the room entered.

In more detail, the mat of the present invention may comprise a lower layer being formed from a repeating array of shapes, an upper layer being formed from a repeating array of shapes; wherein the arrays of the lower and upper layers overlap and are not super-imposed; and wherein the pins protrude from the upper surface of the lower layer and are located within a surrounding formed by the array of shapes of the upper layer. In a preferred embodiment the upper and lower layers both comprise arrays of circles; however other shapes are also contemplated. Additionally, it is not necessary for both layers to have the same shape(s) within their array.

Optionally, linking members may be present to span the spaces between the shapes forming the arrays of both the upper and lower layers. The linking members prevent high heeled footwear becoming wedged in the spaces and also perform a strengthening role. Advantageously, the linking members may be arranged perpendicularly to at least some of the neighbouring linking members.

DESCRIPTION OF DRAWINGS

The present invention will now be further described with reference to the accompanying drawings in which.

DETAILED DESCRIPTION OF DRAWINGS

Figure 1A:
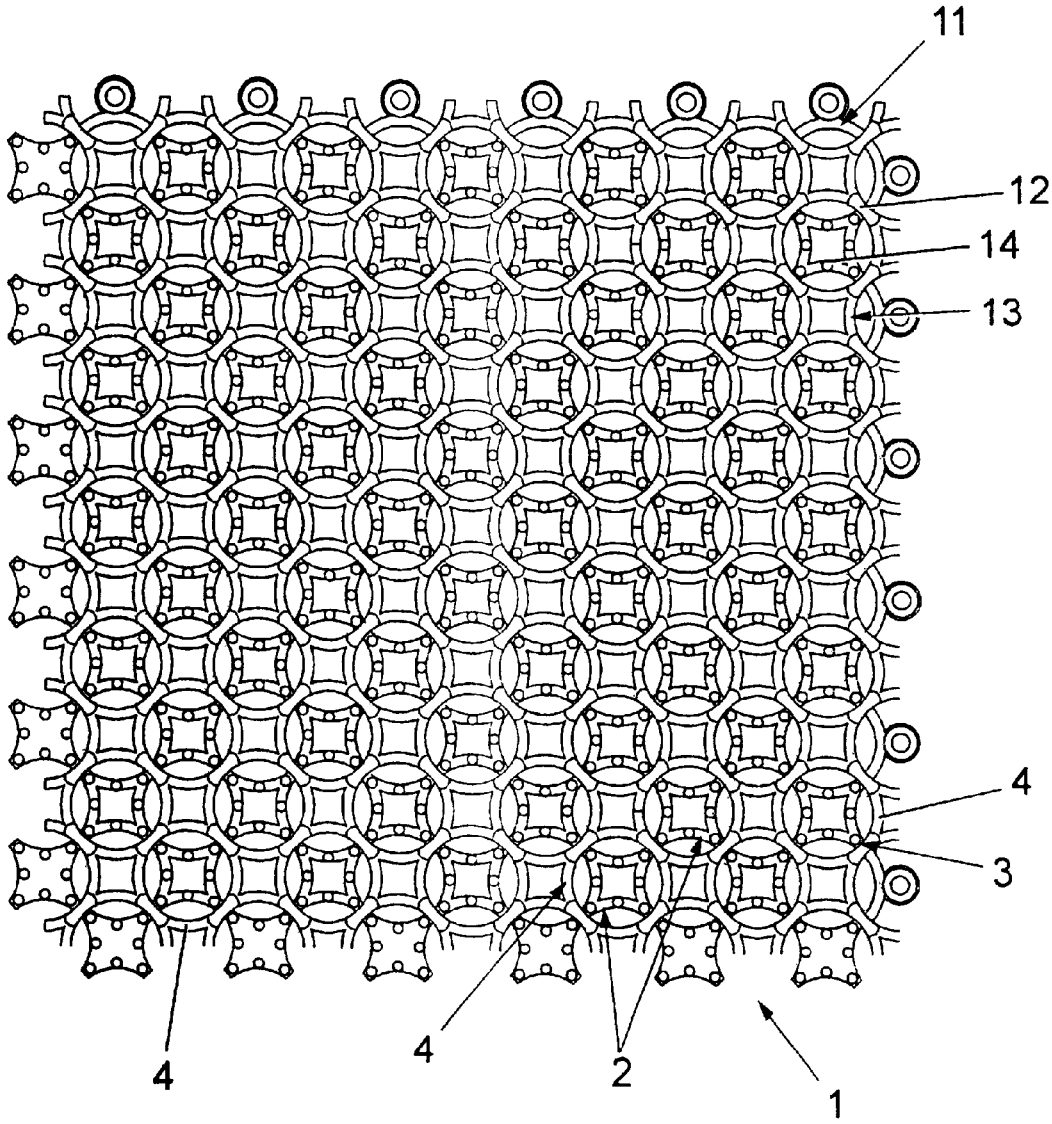
FIG. 1A is a known scraper mat viewed from above.
Figure 1B:
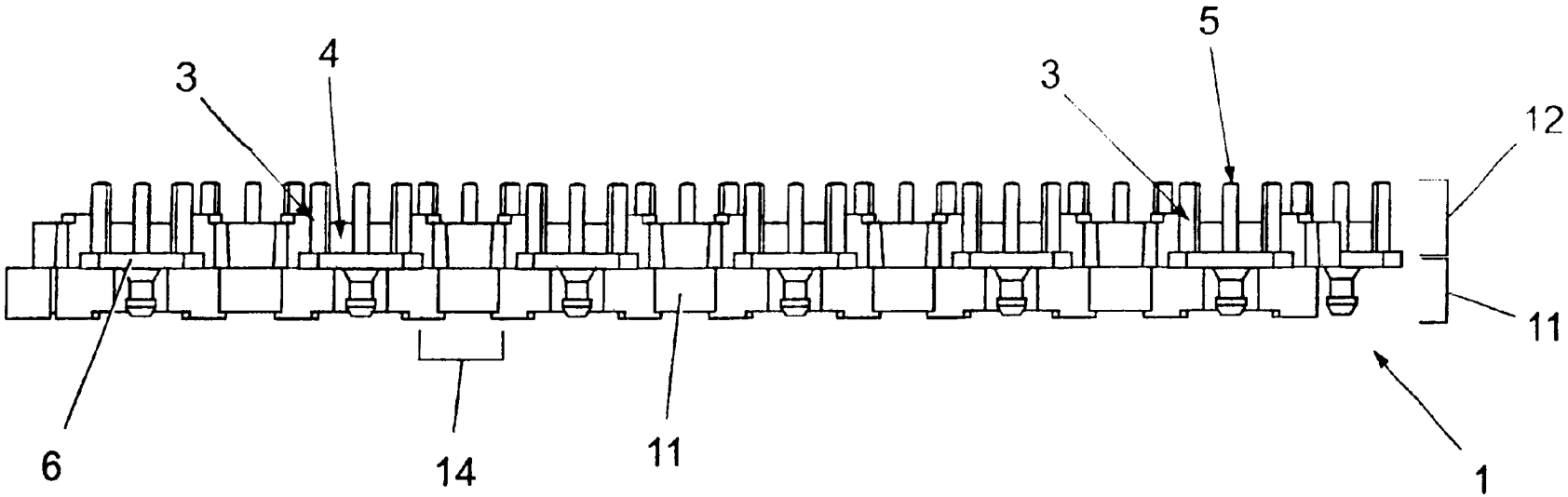
FIG. 1B is a side view of the known scraper mat shown in FIG. A.

In more detail, FIG. 1A shows a view from above of a known scraper mat 1 which comprises multiple sets of pins 2. Each set of pins 2 is formed from eight pins 3 enclosed by a substantially circular surrounding 4. The pins 3 are mounted on a support 6 and extend upwardly therefrom. As viewed from the side in FIG. 1B the unattached or free, upper ends 5 of pins 3 extend beyond surrounding 4 and are readily available for scraping the underneath of footwear.

As is best seen in FIG. 1A, the scraper mat is formed from a lower layer 11 formed from an array of circles and upper layer 12 also formed from an array of circles. These layers 11,12 are arranged so the centre of each circle in the upper layer 12 sits over the approximately square shaped motif 14 formed between neighbouring circles in the lower layer 11. The pins 3 are located on the portions of the four lower layer circles which together form the approximately square shaped motif 14. Consequently, each set of pins 2 is located within the centre of an upper layer circle which forms the surrounding 4 for that set 2.

Figure 2A:
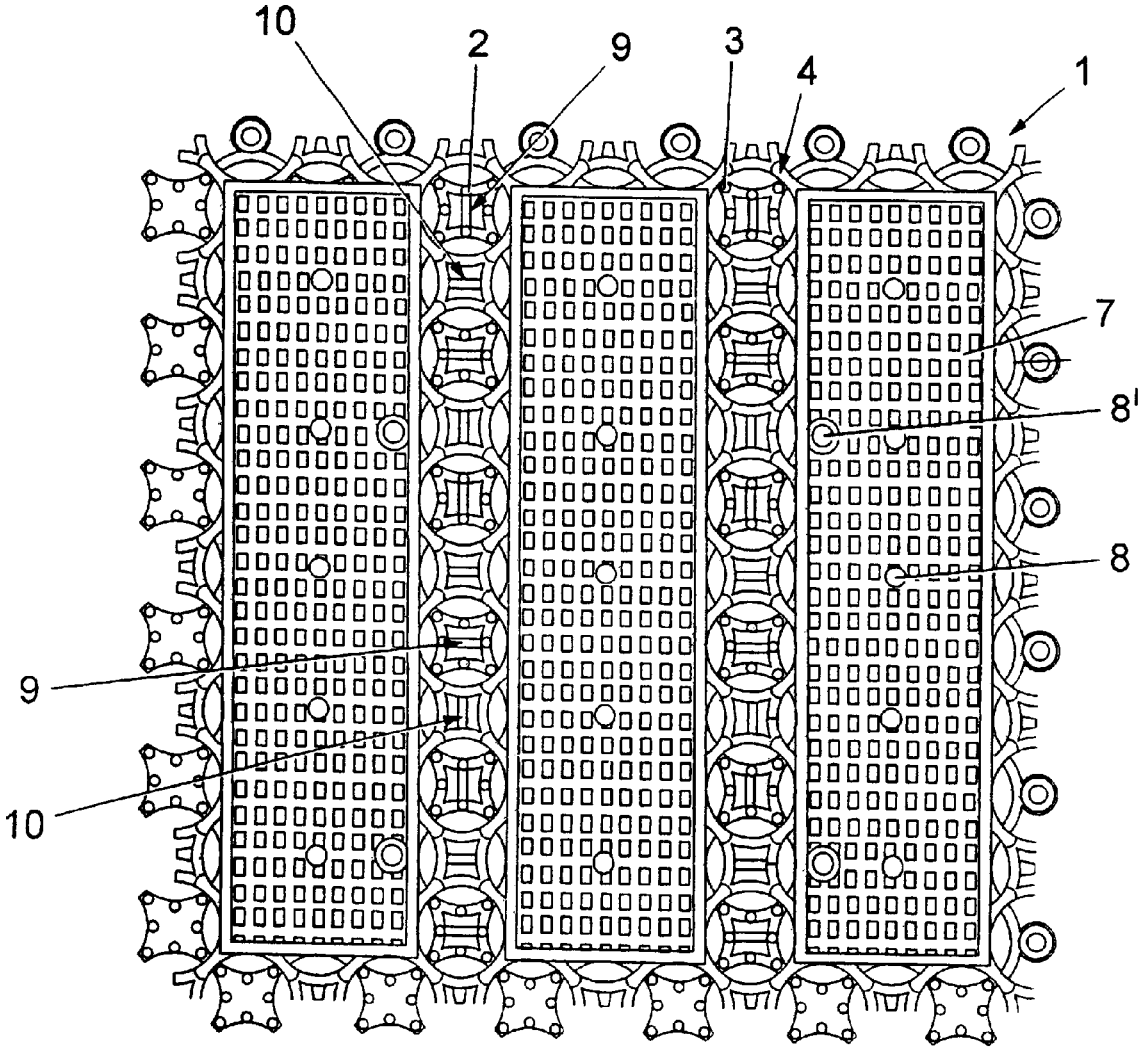
FIG. 2A is a mat according to the present invention having areas adapted for receipt of carpet interspersed between sets of pins.

In FIG. 2A the lower layer 11 in again formed from an array of circles but the upper layer 12 is partially comprised of circles arranged generally as shown in FIG. 1A interspersed by areas 7 adapted for receipt of strips of textile floor covering, eg. carpet. Areas 7 may be of any size or shape required. One convenient size is 14.3 cm×3.8 cm (5⅝×1½ inches). These areas 7 are shown with a pattern on the upper surface thereof, the pattern being intended to facilitate bonding of the carpet to areas 7. Also shown are holes 8 which aid removal of glued carpet and screw holes 8' for fastening the mat 1 firmly to the floor.

The mat 1 shown in FIG. 2A includes linking members 9, 10 located in the approximately square shaped motif 14 by the meeting of four circles in the lower layer 11 and also in the similarly shaped motif 13 formed at the junction of four circles in the upper layer 12. As shown in FIG. 2A, the lower layer linking members 9 and the upper layer linking members 10 are alternately aligned in the general direction of the major axes of the mat.

The mat 1 may be of any desired thickness, but conveniently may be approximately 1.6 cm (⅝ inches), for example 1.3 cm (½ inches).

Figure 2B:
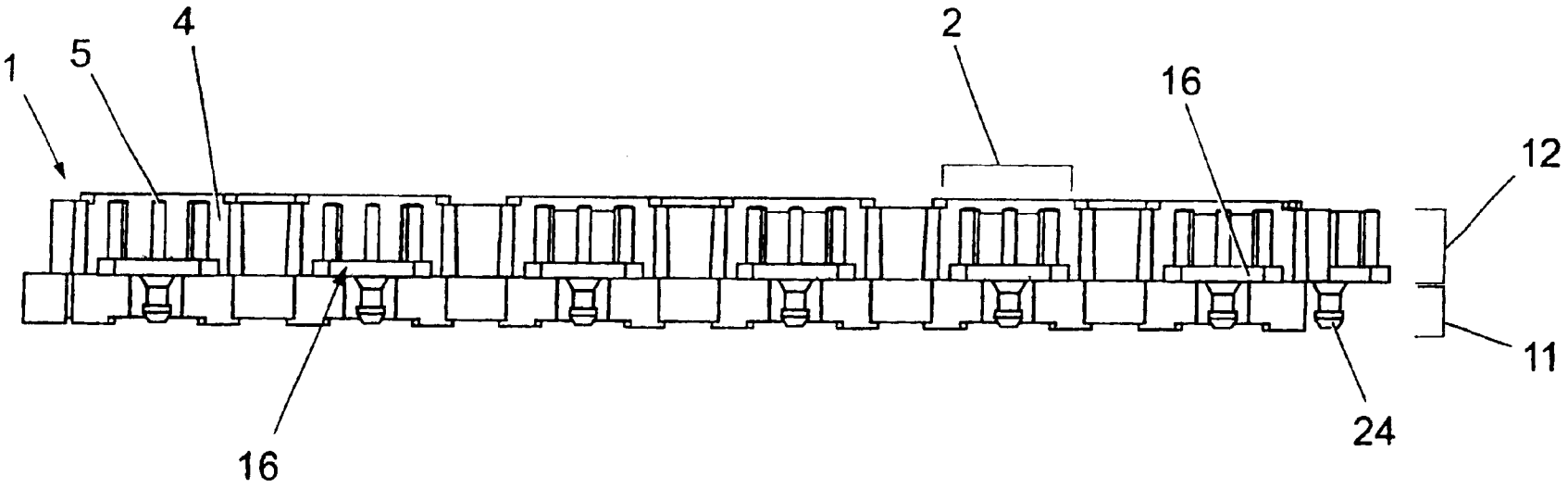
FIG. 2B is a side view of the mat shown in FIG. 2A when viewed along the line BB.

With reference to FIG. 2B, it can be seen that the ends 5 of pins 3 terminate below the upper surface of surrounding 4. Consequently, the pins 3 are protected by the surrounding 4 until a person walks upon the mat 1 depressing the surrounding 4 to expose the ends 5 of pins 3 which then perform the intended scraping function. As illustrated in FIG. 2B the pins 3 are located on a shelf 16 which reduces the length of the pin body required. This reduces the incidence of pin breakage.

Figure 3B:
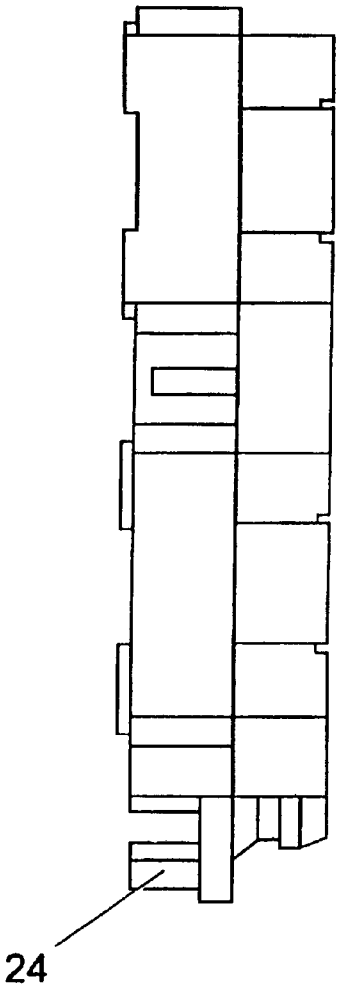
FIG. 3B is a side view of the mat shown in FIG. 3A when viewed from arrow C.
Figure 3A:
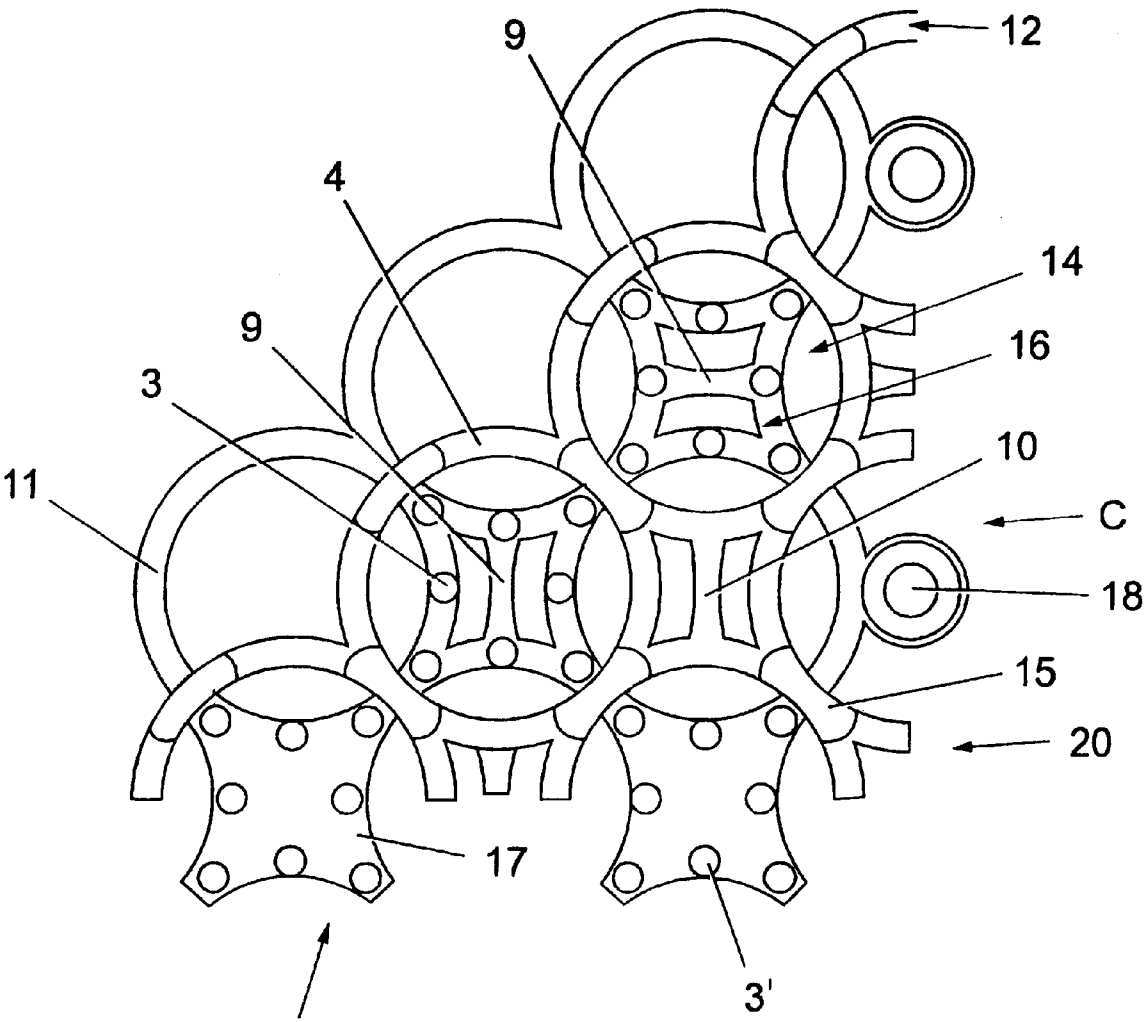
FIG. 3A is a schematic drawing of a corner of a mat according to the invention when viewed from above.

FIG. 3 schematically depicts a corner of a mat according to the present invention, with upper layer 12 being shown partially removed for the purpose of clarity. FIG. 3B shows a side view of the mat 1 depicted in FIG. 3A viewed in the direction of arrow C.

As previously described, mat 1 as shown in FIG. 3A comprises a lower layer 11 formed from an array of circles and an upper layer 12 also formed from an array of circles. Upper layer 12 is aligned over lower layer 11 so that each circle of upper layer 12 is positioned over a square-shaped motif 14 formed at the junction between four neighbouring circles of the lower layer 11. On each motif 14 is located a set of pins 2, there being eight pins 3 per set 2. The circle of the upper layer within which the set 2 is located thus acts as a surrounding 4 for that set 2.

In the embodiment illustrated each circle of the upper layer 12, and thus each surrounding 4, is castellated. There are four equi-distant castellations 15 per surrounding 4 shown, but other arrangements are of course possible. The free ends 5 of pins 3 are desirably of a height mid-way between the height of the castellation 15 and the height of the surrounding 4 on which the castellation 15 is based. Thus, a person stepping onto the mat would depress the castellations 15 underfoot, thus bringing the sole of their footwear into contact with the upper ends 5 of pins 3, which are then able to perform the intended scraping function.

The arrangement shown at edges 19,20 of mat 1 illustrate how a number of mats or floor coverings having edges of these types can be joined together. Essentially a peg 24 located underneath and extending downwardly for each of motifs 17 along edge 19 co-operates with the members 18 of the type shown along. edge 20.

Of course it is not essential (although it may be convenient) for one mat to have both pegs 24 and 17 and members 18. All that Is required for two mats or floor coverings to be joined is for one mat or floor covering to comprise motifs 17 (including peg 24) along the edge to be joined and for the other mat or floor covering to have members 18 along the edge to be joined. It is of course also possible for an edge to include both motifs 17 (including peg 24) and members 18 (for example in an alternating arrangement) provided that any mat or floor covering to be joined thereto has an opposite arrangement such that the two edges can co-operate.

In more detail, edge 19 is formed by lower layer 11 terminating with a solid edging motif 17 of the same general shape as motifs 13, 14. Motif 17 includes a set of pins 3' which are arranged in a generally similar manner to the arrangement on motif 14. The upper layer 12 terminates at the mid-point of the line of circles. Extending downwardly from motif 17 and located off-centre there is a peg 24 (not shown in FIG. 3A, but shown in FIGS. 3B and 2B). Peg 24 is of a shape designed to snap into edging member 18.

Edge 20 is formed with a line of edging members 18, of a shape designed to co-operate with peg 24 and to hold peg 24 in a snap-fit arrangement. Again upper layer 12 terminates at the mid-point of the line of circles. Thus, when peg 24 is located in edging member 8, motif 17 is located within a surrounding formed by two half circles.

Figure 4B:
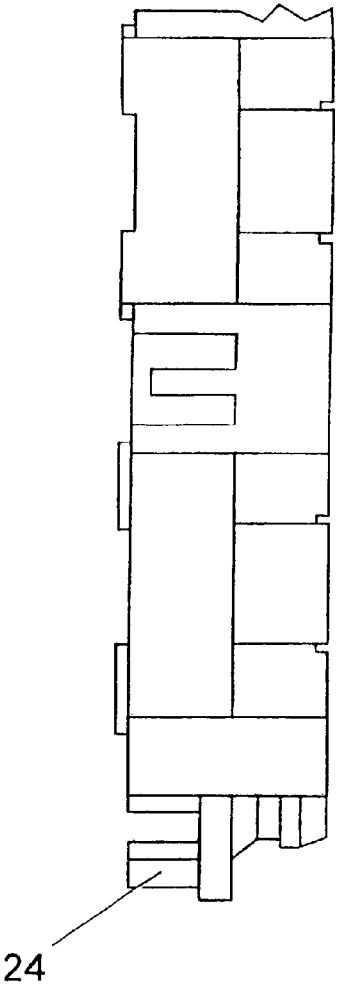
FIG. 4B is a side view of the mat shown in FIG. 4A when viewed from arrow D.
Figure 4A:
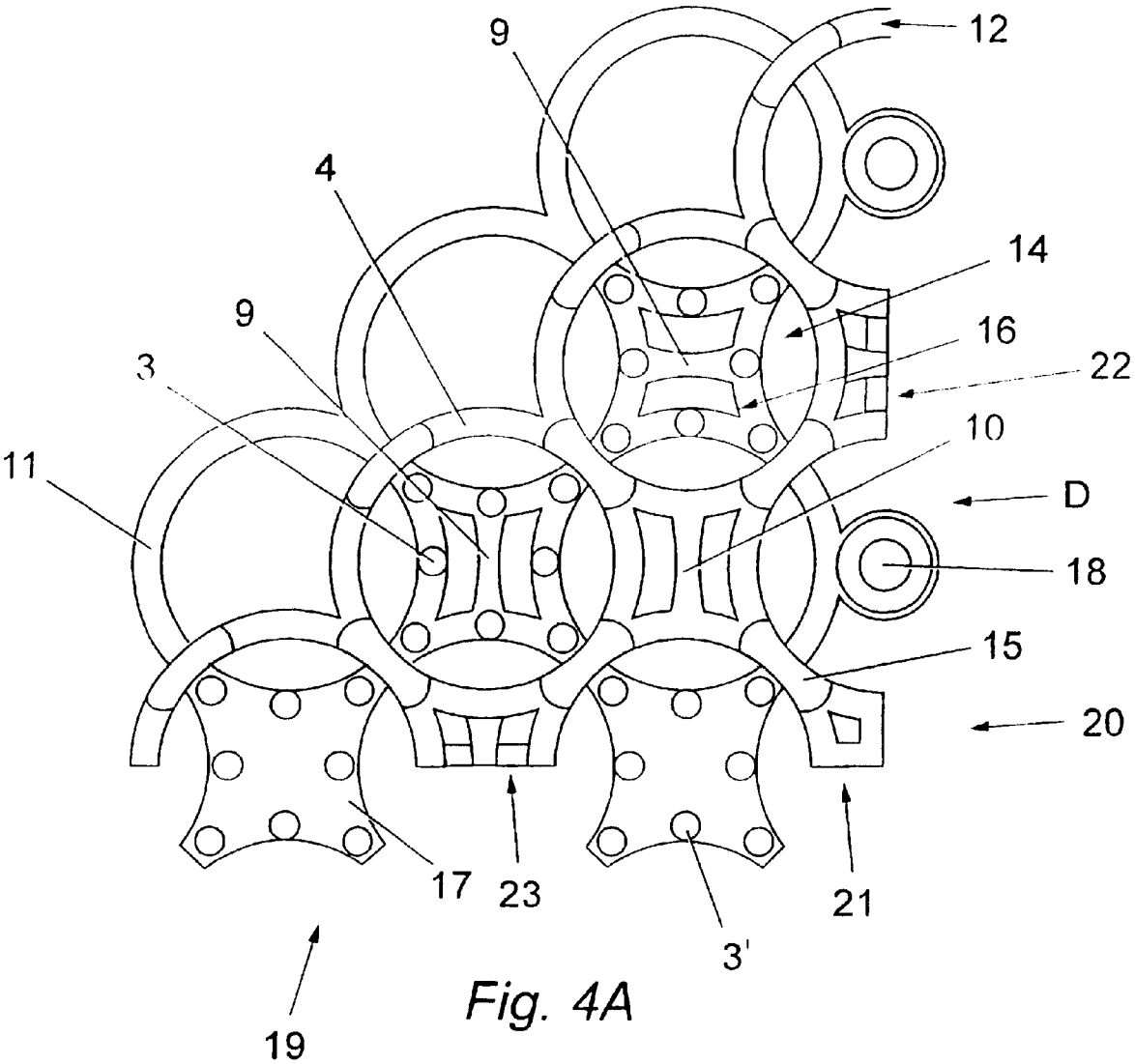
FIG. 4A is a schematic drawing of a corner of a mat according to the invention when viewed from above and including edging strengthening pieces.

FIG. 4A schematically depicts a corner of a mat according to the present invention, with upper layer 12 being shown partially removed for the purpose of clarity. FIG. 4B shows a side view of the mat 1 depicted in FIG. 4A viewed in the direction of arrow D.

FIGS. 4A and 4B depict a mat 1 which differs to that shown in FIGS. 3A and 3B only in the detail of edges 19 and 20. Thus in the embodiment illustrated in FIGS. 4A and 4B strengthening members 21, 22 and 23 are shown along edge 19, at the corner, and along edge 20 respectively. These strengthening members, in addition to providing greater structural support, also help prevent high heels becoming lodged in the spaces of the mat.

What is claimed is:

1. A mat having:

(a) multiple sets of pins, each set of pins being located within a surrounding;

(b) a lower layer that is formed from a repeating array of shapes;

(c) an upper layer that is formed from a repeating array of shapes;

wherein the arrays of the upper and lower layers overlap and are not superimposed; and wherein the pins protrude from the upper surface of the lower layer and are located within a surrounding formed by the array of shapes of the upper layer and the height of the pins is at most no higher than the highest point of the surrounding.

2. A mat as claimed in claim 1 wherein the height of at least some of the pins is below the height of the surrounding for said pin or pins.

3. A mat as claimed in claim 1 wherein at least some of the pins are tapered or rounded at their free end.

4. A mat as claimed in claim 1 wherein the surrounding of a set of pins is ridged or castellated.

5. A mat as claimed in claim 1 having 6 to 8 pins per set.

6. A mat as claimed in claim 1 wherein the repeating arrays of the upper and lower layers are in a shape selected from the group consisting of circles, ovals, triangles, squares, rectangles, pentagons, hexagons, septagons, octagons, and a mixture of these shapes.

7. A mat as claimed in claim 6, wherein the upper and lower arrays of repeating shapes are in the same shape.

8. A mat as claimed in claim 6, wherein the repeating arrays of the upper and lower layers are in the shape of a circle.

9. A mat as claimed in claim 8, further comprising linking members that span the spaces between the shapes of the arrays of the upper and lower layers, said linking members being located in the approximately square shaped motif formed by the junction of four circles of the upper and lower layers.

10. A mat having:

(a) multiple sets of pins, each set of pins being located within a surrounding;

(b) a lower layer that is formed from a repeating array of first shapes;

(c) an upper layer that is formed from a second repeating array of shapes, the second repeating array of shapes comprising the first shapes and a second substantially rectangular shape;

wherein the arrays of the upper and lower layers overlap such that the first shapes are not superimposed; and wherein the pins protrude from the upper surface of the lower layer and are located within a surrounding formed by the array of first shapes of the upper layer and the height of the pins is at most no higher than the highest point of the surrounding.

11. A mat as claimed in claim 10, further comprising strips of textile material that are attached to the substantially rectangular shapes of the upper layer, said textile strips being the same shape as the second substantially rectangular shapes of the upper layer.

12. A mat as claimed in claim 10, wherein said textile material is comprised of carpet having a hard backing.

13. A mat as claimed in claim 12, wherein said textile strips are attached by snapping said textile strips into the rectangular shapes of the upper layer.

* * * * *